US006719881B1

(12) United States Patent
Hunter et al.

(10) Patent No.: US 6,719,881 B1
(45) Date of Patent: Apr. 13, 2004

(54) ACID COLLOID IN A MICROPARTICLE SYSTEM USED IN PAPERMAKING

(76) Inventors: Charles R. Hunter, 423 Oliver Rd., Sewickley, PA (US) 15143; Craig W. Vaughan, 8 Black's Woods Rd., Freedom, PA (US) 15042

( * ) Notice: Subject to any disclaimer, the term of this patent is extended or adjusted under 35 U.S.C. 154(b) by 0 days.

(21) Appl. No.: 09/786,426

(22) PCT Filed: Sep. 8, 1999

(86) PCT No.: PCT/US99/20766

§ 371 (c)(1),
(2), (4) Date: Jul. 5, 2001

(87) PCT Pub. No.: WO00/17451

PCT Pub. Date: Mar. 30, 2000

Related U.S. Application Data

(60) Provisional application No. 60/101,377, filed on Sep. 22, 1998.

(51) Int. Cl.[7] ..... D21H 21/10; D21H 23/02; D21H 17/45; D21H 17/47; D21H 17/51; D21H 17/55; D21H 17/63; D21H 17/68; C02F 5/10

(52) U.S. Cl. ..... 162/164.1; 162/168.1; 162/165; 162/183; 252/180; 106/492

(58) Field of Search ..... 162/158, 164.1, 162/164.6, 168.1, 168.3, 168.4, 165, 166, 181.7, 181.8, 183; 252/180–189, 175; 106/497; 210/726–727, 732

(56) References Cited

U.S. PATENT DOCUMENTS

| | | | | | |
|---|---|---|---|---|---|
| 2,485,079 | A | * | 10/1949 | Wohnsiedler et al. | 524/598 |
| 2,485,080 | A | * | 10/1949 | Wohnsiedler et al. | 524/300 |
| 4,385,961 | A | * | 5/1983 | Svending et al. | 162/175 |
| 4,795,531 | A | * | 1/1989 | Sofia et al. | 162/164.6 |
| 5,382,378 | A | * | 1/1995 | Guerrini et al. | 252/181 |
| 5,676,796 | A | * | 10/1997 | Cutts | 162/158 |

* cited by examiner

*Primary Examiner*—Jose A Fortuna
(74) *Attorney, Agent, or Firm*—Michael B. Martin; Thomas M. Breininger

(57) ABSTRACT

A microparticle system for use as a retention and drainage aid in the production of alkaline and acid paper products comprises a HMW flocculent polymer (6), an acid colloid (7), and a coagulant or a MMW flooculant (5). The acid colloid (7) comprises an aqueous solution of a water soluble polymer or copolymer of melamine aldehyde, preferably melamine formaldehyde, and is present in an amount ranging between 0.0005% to 0.5% by weight based on the dry weight of the solids in the furnish. The HMW flocculant polymer (6) may be added to stock or furnish after the fan pump; and prior to the pressure screen (2); the acid colloid (7) may be added to the stock after the pressure screen (2), and the coagulant/MMW flocculant (5) may be added prior to the fan pump (1). Alternatively, this sequence of chemical additions can be changed, i.e. the acid colloid (7) can be added prior to or after the fan pump (1) or prior to the pressure screen (2). Addition of the microparticle system to the paper furnish improves retention, drainage and sheet formation during the papermaking process.

17 Claims, 1 Drawing Sheet

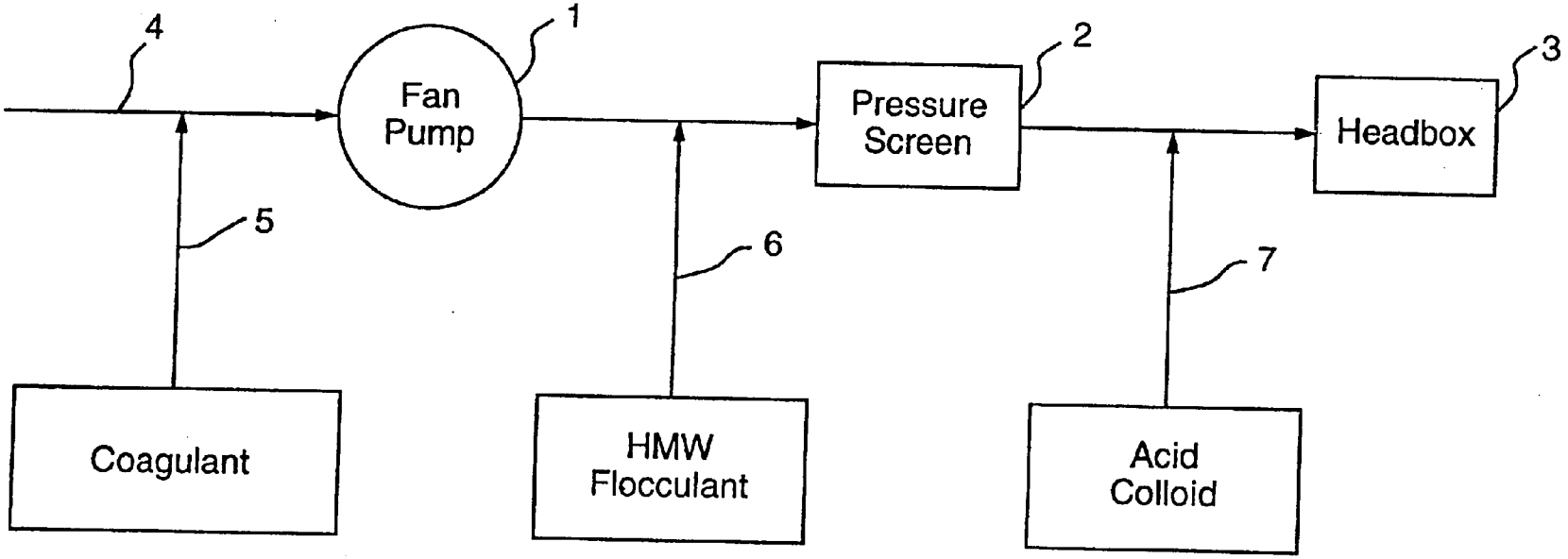
Headbox
3
Pressure Screen
2
Fan Pump
1
Coagulant
4
5
HMW Flocculant
6
Acid Colloid
7

ACID COLLOID IN A MICROPARTICLE SYSTEM USED IN PAPERMAKING

CROSS REFERENCE TO RELATED APPLICATION

This application claims the priority of U.S. Provisional patent application Serial No: 60/101,377 filed on Sep. 22, 1998.

BACKGROUND OF THE INVENTION

1. Field of the Invention

The present invention relates to an improved microparticle system for use as an aid in making a paper product, i.e. paper or paperboard, with improved properties in the areas of retention, drainage, and sheet formation. More particularly, it pertains to a microparticle system comprising an acid colloid as a microparticle or an inorganic particulate material of the microparticle system.

2. Description of the Background Art

In the production of paper or paperboard, a dilute aqueous composition known as "furnish" or "stock" is sprayed onto a moving mesh known as a "wire". Solid components of this composition, such as cellulosic fibers and inorganic particulate filler material, are drained or filtered by the wire to form a paper sheet. The percentage of solid material retained on the wire is known as the "first pass retention" of the papermaking process. Drainage, retention and formation (D/R/F) aids are used in the papermaking process.

Retention is believed to be a function of different mechanisms, such as filtration by mechanical entrainment, electrostatic attraction, and bridging between the fibers and the fillers in the furnish. Because both the cellulosic fibers and many common filler materials are negatively charged, they are mutually repellent. Generally, the only factor tending to enhance retention is mechanical entrainment. Therefore, a retention aid is generally used to improve retention of the fibers and fillers on the wire. The retention of fines and fillers is important to the papermaker to insure the capture of colloidally sized particles in the sheet. First pass retention (FPR) measures this ability of a retention program. Colloidal silica has been used in the past as a microparticle in a retention aid for alkaline fine paper. Silica has to be used properly in order to enhance the retention of fines and fillers by forming microflocs that capture colloidal material and allow the pulp slurry to dewater quickly.

Drainage relates to the rate of removal of water from the stock or furnish as the paper sheet is formed. Drainage usually refers to water removal that takes place before any pressing of the paper sheet subsequent to formation of the sheet. Thus, drainage aids are used to improve the overall efficiency of dewatering in the production of paper or paperboard.

Formation relates to the formation of the paper or paperboard sheet produced in the papermaking process. Formation is generally evaluated by the variance of light transmission within a paper sheet. A high variance is indicative of "poor" formation and a low variance is generally indicative of "good" formation. Generally, as the retention level increases, the level of formation generally decreases from good formation to poor formation.

It can be appreciated that improvements in retention and drainage and in the formation properties of the paper or paperboard sheet are particularly desirable for several reasons, the most significant of which is productivity. Good retention and good drainage enable a paper machine to run faster and to reduce machine stoppage. Good sheet formation lessens the amount of paper wastage. These improvements are realized by the use of retention and drainage aids. Retention and drainage aids are additives that are used to flocculate the fine solid material present in the stock or furnish to improve these parameters in the papermaking process. The use of such additives is limited by the effect of flocculation on the paper sheet formation. If more retention aid is added so the size of the aggregates of the fine solid material is increased, then this generally results in variations in the density of the paper sheet which, as stated herein above, may result in what is referred to as "poor" sheet formation. Over-flocculation can also affect drainage as it may eventually lead to holes in the sheet and/or to a subsequent loss of vacuum pressure in the later stages of dewatering during the papermaking process. Retention and drainage aids are generally added to the furnish in the wet-end of the paper machine, and generally are of three types, viz:

(a) single polymers;

(b) dual polymers; or (c) a microparticle systems which may include flocculant and/or a coagulant.

A microparticle system generally gives the best result as a retention and drainage aid, and has been widely described in the prior art. In the past years, bentonite clay and colloidal silica have been used to improve drainage, retention, and formation.

Examples of publications describing microparticle systems include: EP-B-235, 893 wherein bentonite is used as the inorganic material in conjunction with a high molecular weight cationic polymer in a specified addition sequence; WO-A-94/26972 wherein a vinylamide polymer is disclosed for use in conjunction with one of various inorganic materials such as silica, bentonite, china clay, and organic materials; WO-A-97/16598 wherein kaolin is disclosed for use in conjunction with one of various cationic polymers; and EPO 805234 wherein bentonite, silica, or acrylate polymer is disclosed for use in conjunction with a cationic dispersion polymer.

U.S. Pat. Nos. 4,305,781 and 4,753,710 disclose the use of high molecular weight nonionic and ionic polymers in conjunction with bentonite clay to aid in dewatering and retention in papermaking. U.S. Pat. Nos. 4,388,150 and 4,385,961 teach the use of cationic starch and colloidal silica. U.S. Pat. Nos. 4,643,801 and 4,750,974 describe the use of cationic starch, anionic high molecular weight polymer, and colloidal silica in papermaking. U.S. Pat. No. 5,185,062 describes anionic polymer acting as a microparticle with a high molecular weight cationic flocculant. U.S. Pat. No. 5,167,766 teaches the use of charged organic polymeric microbeads as a microparticle in papermaking.

A microparticle system generally comprises a polymer flocculant with or without a cationic coagulant and a fine particulate material. The fine particulate material improves the efficiency of the flocculant and/or allows smaller, more uniform flocs to be produced.

The use of melamine-formaldehyde (MF) acid colloids for wet strength in paper is well known. Reference is made to TAPPI Monograph No. 29 "Wet Strength in Paper and Paperboard", C. S. Maxwell, J. P. Weidner, ed. U.S. Pat. No. 2,345,543 describes the preparation of stable melamine-formaldehyde acid colloids. U.S. Pat. No. 2,485,080 includes the incorporation of urea into the condensation products. U.S. Pat. Nos. 2,559,220 and 2,986,489 teach the use of these colloids to increase the wet strength of paper. U.S. Pat. No. 4,845,148 describes the use of amino-aldehyde acid colloid with acrylamide for increasing dry strength of paper. U.S. Pat. No. 5,286,347 describes the use of melamine formaldehyde colloid for pitch control in papermaking. U.S. Pat. No. 4,461,858 describes the use of polyvinyl alcohol—melamine formaldehyde colloid blends for wet-strength in paper. U.S. Pat. No. 4,009,706 teaches the use of melamine formaldehyde colloid and anionic high molecular weight polymer to flocculate raw sugar.

In spite of the several microparticle systems presently available for use in the paper mills to attain better runnability of the paper machine and/or to obtain a specific end use paper property, such as improved sheet formation for better printability, or improved surface strength, there remains a very real and substantial need for a microparticle system for improving the paper or paperboard by improving drainage and retention during the papermaking process and sheet formation properties in the formed sheet.

SUMMARY OF THE INVENTION

The present invention has met this above described need. The present invention relates to a microparticle system used as a retention and drainage aid in a papermaking process.

According to a first aspect of the present invention, there is a method of producing paper which comprises adding to a paper furnish a microparticle system as a retention and/or drainage aid which comprises a high molecular weight polymer flocculent and an inorganic particulate material comprising acid colloid comprised of an aqueous solution of a water soluble polymer or copolymer.

According to a second aspect of the present invention, there is a microparticle system which is added to a paper furnish as a retention and/or drainage aid, and which microparticle system comprises a high molecular weight polymer flocculant and an inorganic particulate material comprising an acid colloid comprised of an aqueous solution of a water-soluble polymer or copolymer.

According to a third aspect of the present invention, there is a paper or a paperboard product with improved properties in the area of retention, drainage and formation wherein the paper or paperboard product is made by adding a microparticle system to an aqueous cellulosic paper furnish, wherein the microparticle system comprises a high molecular weight polymer flocculant and an inorganic particulate material comprising an acid colloid comprised of an aqueous solution of a water-soluble polymer or copolymer.

A fourth aspect of the invention involves a process in which paper or paperboard is made by forming an aqueous cellulosic paper furnish, the steps comprising:

(a) adding to the thin stock flow of a paper furnish a high molecular weight polymer flocculant after a first shearing stage, (b) at least after a second high shearing stage adding an inorganic particulate material comprising an acid colloid comprised of an aqueous solution of a water-soluble polymer or copolymer;

(c) draining the paper furnish to form a sheet; and (d) drying the sheet.

In the several aspects of the invention and in a preferred embodiment, the acid colloid is comprised of an aqueous solution of a water-soluble polymer selected from the group consisting of melamine aldehyde, urea aldehyde, and melamine-urea aldehyde and the aldehyde is

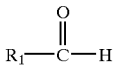

wherein R1 is selected from the group consisting of straight and branched $C_{1-4}$ alkyl. The acid colloid is present in the stock or furnish in an amount ranging from about 0.0005% to about 0.5% by weight based on the dry weight of the solids in the stock or furnish.

Preferably, the aldehyde is formaldehyde and the acid colloid is melamine formaldehyde, which may be etherfied with a linear or branched alcohol.

The high molecular weight (HMW) polymer flocculant is present in an amount ranging from about 0.0025% to about 1.0% by weight based on the dry weight of the solids in the furnish. A high charge density cationic coagulant may be added to the stock or furnish prior to a first shearing stage or may in some instances be added prior to or after the addition of the acid colloid. Alternatively, the acid colloid and/or the flocculant could be added to the stock or furnish prior to the HMW flocculant and/or the coagulant and/or prior to the first shearing stage.

BRIEF DESCRIPTION OF THE FIGURES

The single FIGURE illustrates a portion of a typical paper machine and the points of addition of the components of the microparticle system of the present invention in a preferred form.

DETAILED DESCRIPTION OF THE INVENTION

The invention is directed to a microparticle system used as a retention/drainage/formation (R/D/F) aid for particular use in the wet end of a paper machine in the papermaking process for both acid and alkaline fine paper.

As used herein, the term "paper" includes products comprising a cellulosic sheet material including paper sheet, paper board, and the like.

The "microparticle system" of the invention refers to the combination of at least one hydrophilic polymer used as a flocculant and at least one inorganic particulate material which is a microparticle in the system, and possibly, a coagulant. In the invention, the microparticle or inorganic particulate material is an acid colloid. The components of this combination may be added together to the stock or furnish to be treated, but are preferably added separately in the manner and order described herein below.

The invention can be carried out using a conventional papermaking machine. According to conventional practice, the furnish or "thin stock" that is drained to form the paper sheet is often made by diluting a thick stock which typically has been made in a mixing vessel or chest by blending pigment or filler material, the appropriate fiber, any desired strengthening agent and/or other additives, and water which may be recycled water. The thin stock may be cleaned in a conventional manner, e.g., using a vortex cleaner. Usually the thin stock is cleaned by passage through a centriscreen. The thin stock is usually pumped along the paper machine by one or more centrifugal pumps known as fan pumps. For instance, the thin stock may be pumped to the centriscreen by a first fan pump. The thick stock can be diluted by water to form the thin stock prior to the point of entry to this first fan pump or prior to the first fan pump, e.g., by passing the thick stock and dilution water through a mixing pump. The thin stock may be cleaned further by passage through a second centriscreen or pressure screen and passed through a headbox prior to the sheet forming process of a paper machine.

The sheet forming process may be carried out by use of any conventional paper or paperboard forming machine, for example a flat wire fourdrinier, a twin wire former, or a vat former, or any combination of these forming machines. An approach system to a paper machine may comprise the components shown in the single figure. These components include a fan pump 1, a pressure screen 2, and a headbox 3. The thick stock may be diluted by water to form a thin stock prior to the stock's entry into fan pump 1 by passing the thick stock and dilution water through a mixing pump (not shown). The thin stock is cleaned of contaminants by passage through pressure screen 2 and the thin stock that leaves pressure screen 2 is passed to headbox 3 prior to forming the sheet.

The single figure also illustrates the preferred points of addition for the components of the microparticle system of the present invention. Preferably, the coagulant is added to the thin stock prior to the thin stock being passed through fan pump 1 which travel is indicated by arrow 4 and which addition is indicated by arrow 5. The flocculant is added to the thin stock as it exits fan pump 1, as indicated by arrow 6, and the microparticle particulate material comprising acid colloid is added to the thin stock as the thin stock exits pressure screen 2 as indicated by arrow 7. Fan pump 1 and pressure screen 2 produce high shear stages in the paper machine.

In the invention, the high molecular weight (HMW) flocculant polymer of the microparticle system is preferably added before the thin stock reaches the last point of high shear and the resultant thin stock is preferably sheared, e.g., at the last point of high shear, and preferably before adding the acid colloid material of the microparticle system of the invention. In the single figure, the flocculant is shown as being added before the thin stock travels through pressure screen 2 and the acid colloid is shown as being added after the stock passes through pressure screen 2.

Preferably, the HMW polymer flocculant of the microparticle system of the invention is added to the thin stock (i.e. having a solids content of desirably not more than 2% or, at the most, 3% by weight) rather than to the thick stock. Thus, the HMW flocculant polymer may be added directly to the thin stock or it may be added to the dilution water that is used to convert thick stock to thin stock.

The high molecular weight flocculant polymer generally comprises an agent for aggregating the solids, especially the fines, in the papermaking furnish. As used herein, "fines" means fine solid particles and fibers as defined in TAPPI Test Methods T261 and T269, respectively.

Flocculation of the fines in the stock or furnish may be brought about by the high molecular weight polymer itself or in combination with a medium molecular flocculant or a coagulant which may be a high charge density cationic coagulant. Flocculation of fines gives better retention of the fines in the fiber structure of the forming paper sheet, thereby giving improved dewatering or drainage.

The high molecular weight polymer flocculant is a polymer providing flocculant action, preferably, by itself.

Examples of high molecular weight polymer flocculants suitable for use herein are those having a weight average molecular weight of about 100,000 or more, especially 500,000 or more. Preferably, the weight average molecular weight is about above 1 million and often above about 5 million, and typically, in the range 10 to 30 million or more. These polymers may be linear, branched, cationic, anionic, nonionic, amphoteric, or hydrophobically modified polymers of acrylamide or other nonionic monomers.

The amount of high molecular weight polymer flocculant of the microparticle system added to the paper furnish in the present invention may be any amount sufficient to give a substantial effect in flocculating the solids, especially the fines, which are present in the paper furnish. The total amount of water soluble flocculant polymer added may be in the range of about 0.0025% to about 1.0%, more preferably, in the range 0.01% to 0.2%, and most preferably, in the range of about 0.0125% to about 0.1% by weight (dry weight of polymer based on the dry weight of the solids present in the furnish). The addition may be carried out in one or more doses at one or more addition sites and, preferably, is carried out in one dose to the thin stock flow after the fan pump, which causes a high shear action.

Desirably, the flocs formed by the high molecular weight polymer flocculant are subjected to a shearing action before addition of the acid colloid of the microparticle system of the invention. Preferably, this shearing action is induced by a pressure screen which causes a high shear action.

In the invention, the acid colloid is comprised of an aqueous solution of a water insoluble polymer or copolymer. In a preferred embodiment, any melamine aldehyde type polymer or copolymer can be used. Preferably, the polymer is prepared by using a) melamine or a substituted melamine; and b) an aldehyde having the formula:

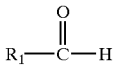

wherein R1 is selected from the group consisting of straight and branched $C_{1-4}$ alkyl. The preferred aldehydes are methanal (formaldehyde), ethanal, propanal, gloyoxal and glutaraldehyde, the most preferred aldehyde being formaldehyde.

The mole ratio of component a) to component b) above should range from about 1:1 to about 1:10, with the preferred ratio being about 1:3 to 1:6. The most preferred mole ratio is about 1 mole of melamine or derivative thereof to about 3 moles of an aldehyde. Thus the most preferred polymer is prepared from melamine and formaldehyde, and the mole ratio of melamine to formaldehyde is about 1:3.

The melamine aldehyde type polymers of the present invention are insoluble in water, but can be maintained in a colloidal suspension in acidic solutions. Any acid or compatible combination of acids can be used to prepare the melamine aldehyde acid colloids, although hydrochloric acid is preferred. The active content of the melamine aldehyde-type polymer in acidic suspension or solution should range from about 0.1% to about 20%, preferably 1% to about 15%, and most preferably, about 4% to about 12%. The pH should be sufficiently low, i.e., between 1.0 to 2.5 with an aqueous mineral or organic acid, in order to keep the melamine aldehyde type polymer in fine colloidal suspension.

Urea aldehyde type polymer solutions suitable for use in the present invention are those wherein the aldehyde is defined as above, most preferably urea-formaldehyde solutions. The mole ratio of urea to aldehyde should range from 1:1 to 1:10, with the most preferred ratio being 1:3 to 1:6.

Melamine urea aldehyde copolymer solutions may also be employedlin the present invention. These solutions are prepared from an aldehyde component as described above, urea, and melamine or a substituted melamine. Preferred are melamine-urea-formaldehyde copolymer solutions. The melamine-urea-aldehyde copolymer solutions suitable for use in the present invention contain 1 to 70 mole percent urea, 30 to 99 mole percent melamine, and about 1 to 4 moles of aldehyde for each mole of combined melamine and urea in the acidic aqueous medium. The copolymer solution for use in the present invention ranges from 0.1 to 20 percent solids, and preferably 1 to 12 percent solids.

The acid colloid of the invention may be a copolymer comprising melamine aldehyde and condensates which include ammeline-aldehyde, dicyandiamidealdehyde, biguanidine-aldehyde, ureaformaldehyde polyalkylene polyamine, and polyureido.

The acid colloid is prepared by reaction of the specified aldehydes with the amine and aging the solution under acid conditions, typically using hydrochloric acid. As aging proceeds, the colloidal particles grow to a size of 20 to 200 Angstroms. The average degree of polymerization is 10 to 20 methylolated melamine units. The particle carries a cationic charge, i.e. some of the secondary amine units are protonated. The colloidal suspensions characteristically exhibit a blue haze. The suspension are stored at a concentration of 8–12% active polymer. The suspensions may be composed exclusively of amine and aldehyde, or may be derivatives thereof. The suspensions may be partially etherified with an alcohol, glycol, or other hydroxyl containing species. The suspensions may be a co-condensate of melamine-formaldehyde and another aminoplasts, which are then used to form the acid colloid. The aminoplasts that form the colloid may also be copolymers of ethylenically unsaturated monomers such as acrylamide, dimethylaminoethyl acrylate, diallyldimethyl ammonium chloride, or methacrylamidopropyl trimethylammonium chloride. In the invention, these acid colloids are now being applied as part of a microparticle drainage, retention, and formation program with respect to making paper or paperboard.

In the preferred embodiment, the acid colloid may be that disclosed in the aforesaid U.S. Pat. No. 5,382,368 which is incorporated herein by reference. The amount of acid colloid added to the paper furnish ranges between about 0.0005% to about 0.5%, and preferably, between about 0.005% to about 0.25% by dry weight based on the dry weight of the solids present in the paper stock or furnish. This addition may be carried out in one or more dosages at one or more feed points or addition sites, but preferably, in one dose, and preferably, after the pressure screen 2 in the figure and at least between pressure screen 2 and headbox 3. The acid colloid of the microparticle system of the invention preferably is melamine-formaldehyde acid colloid.

The addition of the high molecular weight (HMW) flocculant polymer generally will cause the formation of large flocs of the suspended solids in the paper furnish to which the polymer is added. These large flocs are immediately or subsequently broken down by high shear to very small flocs that are known in the art as "microflocs". This "high shear" may be induced by passing the flocced paper furnish through the pressure screen 2 of the figure.

A water soluble polymer, generally lower in molecular weight than the flocculant, may be employed as a coagulant by its addition to the thick stock, and preferably is added to the furnish prior to the furnish passing through fan pump 1. This coagulant may be a high charge density cationic polymer. For instance, if the coagulant polymer is a nitrogen containing cationic polymer, it may have a charge density of about 0.2, preferably, at least 0.35 and, most preferably, 0.4 to 2.5 or more, equivalents of nitrogen per kilogram of polymer. When the polymer is formed by polymerization of cationic, ethylenically unsaturated, monomer optionally with other monomers, the amount of cationic monomer will normally be about 2 mole % and usually about 5 mole %, and, preferably, at least about 10 mole %, based on the total amount of monomers used for forming the polymer.

Both natural and synthetic inorganic and organic coagulants can be used in the microparticle system of the invention. If the coagulant is cationic, suitable cationic coagulants include: polydiallyldimethyl ammonium chloride (p-DADMAC); polyalkylamines; cationic polymers of epichlorohydrin with dimethylamine and/or ammonia or other primary and secondary amines; polyamidoamines; copolymers of a non-ionic monomer, such as acrylamide, with a cationic monomer, such as DADMAC or acryloyloxyethyltrimethyl ammonium chloride; cyanoguanidine modified polymers of urea/formaldehyde resins; melamine/formaldehyde polymers; urea/formaldehyde polymers; polyethylene imines; cationic starches; monomeric and polymers of cationic aluminium salts; amphoteric polymers processing a net cationic charge; and blends of the aformentioned coagulants.

The amount of coagulant of the microparticle system of the invention added to stock or furnish may be any amount sufficient to give a substantial effect in coagulating the solids present in the paper furnish. The total amount of water soluble coagulant polymer may be in the range of about 0.0025 to 1.0%, and more preferably, in the range of about 0.005% to about 0.50% by weight (dry weight of polymer based on the dry weight of the solids present in the paper furnish).

If a medium molecular weight (MMW) flocculant is used instead of the cationic coagulant, this flocculant may be added prior to the stock passing through fan pump 1. Examples of a MMW flocculant suitable for use in the invention are those having a weight average molecular weight ranging from 500,000 to about between 5 and 6 million. This chemical additive may be a copolymer of an acrylamide or any unsaturated monomer. A suitable MMW flocculant may include the-ECCat™ 500 copolymers available from Calgon Corporation, Pa.

The amount of MMW flocculant may be any amount sufficient to give a substantial effect in coagulating the solids present in the paper or furnish. The total amount of MMW flocculant may be in the range of about 0.0025 to 1.0 wt. % based on the dry weight of the solids present in the furnish. The dosages would range from 0.01 to 5.0 lb./ton polymer.

As mentioned herein above, the coagulant or MMW flocculant may be added to the thick stock prior to the fan pump 1, the HMW flocculant polymer may be added to the thin stock after the stock's passage through fan pump 1, and the acid colloid of the invention may be added to the thin stock after the stock's passage through pressure screen 2. Alternatively, these chemical additives may be added to the stock in a different sequence and/or at different feed points than that shown in the figure.

The initial thick stock can be made from any conventional papermaking furnish, such as, traditional chemical pulps, for instance bleached and unbleached sulphate or sulphite pulp; mechanical pulps such as groundwood; thermomechanical pulp; or chemi-thermochemical pulp; or recycled pulp, such as deinked waste, fiber filler composites from aggregating or recycling processes; and any mixtures thereof.

The stock or furnish employed in the invention, and in the final paper, can be substantially unfilled (e.g., containing less than 10% and generally less than 5% by weight filler in the final paper), or filled with a filler which can be provided in an amount of up to 50% by weight based on the dry weight of the solids of the stock or up to 40% by weight based on the dry weight of the paper. When filler is used, any conventional white pigment filler, such as calcium carbonate, kaolin clay, calcined kaolin, titanium dioxide, or talc, or a combination thereof may be present. The filler (if present) is, preferably, incorporated into the furnish in a conventional manner, and before addition of the components of the microparticle system of the invention.

The stock or furnish employed in the invention may include other known optional additives, such as, rosin, alum, neutral sizes or optical brightening agents. It may include a strengthening or binding agent, and this can, for example, comprise a starch, such as cationic starch. The pH of the stock is generally in the range of from about 4 to about 9.

The amounts of fiber, filler, and other additives, such as, strengthening agents, or alum can all be conventional. Typically, the thin stock has a solids content of 0.1% to 3% by weight, or a fiber content of 0.1% to 2% by weight. The thin stock will usually have a solids content of from 0.1% to 2% by weight. These percentages are based on the dry weight of the solids in the stock.

The acid colloid employed as the microparticle particulate material in the microparticle system of the invention is preferably melamine-formaldehyde acid colloid or derivatives thereof. Preferably, the acid colloid is comprised of an aqueous solution of a water-soluble polymer or copolymer, which is preferably a melamine aldehyde, preferably melamine formaldehyde. These particles are readily dispersed in the aqueous pulp suspension in a papermaking process to enhance the surface characteristics of the final paper product. These particles, in general, will have an average particle size of about 10 to about 20 nm.

The inventors have found that an acid colloid, i.e. melamine formaldehyde, in conjunction with a flocculant and a coagulant can increase drainage and retention, and improve sheet formation in a papermaking process.

Experiments

The following examples demonstrate the invention in greater detail and are not intended to limit the scope of the invention in any way. In the examples, melamine formaldehyde is compared to colloidal silica as a microparticle. Cationic starch was used as a cationic coagulant. In these examples, the following products were used:

An anionic flocculant—a 28 wt % active anionic acrylamide—acrylic acid copolymer available from Calgon Corporation (Pittsburgh, Pa.), comprising about 70 weight % acrylamide and about 30 weight % acrylic acid.

Melamine-formaldehyde (MF) acid colloid—a 8% active solution available from Calgon Corporation (Pittsburgh, Pa.).

Colloidal Silica—a 15% active solution available from Nalco (Naperville, Ill.).

Carbital 60—a dry, ground calcium carbonate available from ECC International, Inc. (Atlanta, Ga.).

Stalok® 400 and Interbond C—cationic starches available from A. E. Staley. (Stalok® is a registered Federal trademark of A. E. Staley.)

Hercon 70—an AKD (alkylketene dimer) size available from Hercules, Inc.

EXAMPLES 1–23

Alkaline Fine Parer Furnish Furnish Preparation

A synthetic alkaline paper furnish was prepared and used in drainage and retention tests and in making handsheets. The following components were used:

Fiber: 50/50 wt % bleached hardwood Kraft/bleached softwood Kraft

Filler: 50/50 wt % ground calcium carbonate (Carbital 60)/precipitated calcium carbonate.

Filler loading: 20 wt % based on fiber solids

Starch: 0.5 wt % (Interbond C) based on fiber solids

Size: 0.25 wt % Hercon 70 (AKD)

A dry lap pulp was soaked in tepid water for 10 minutes, diluted in water to a consistency of 2 wt % solids, and refined or beaten with a Laboratory Scale Voith Allis Valley Beater to a Canadian Standard Freeness (CSF) of 590 ml. The starch, size, and fillers were added in this sequence to the refined pulp slurry. The pH of the pulp slurry was typically 7.5±0.3. The pulp slurry was diluted further with tap water to approximately 1.0 wt % consistency to form thin stock for testing. The furnish is representative of a typical alkaline fine paper furnish used to make printing and writing grades of paper, and was used in Examples 1 through 23.

Drainage Test Procedure 1. 200 ml (2 g solids) of furnish at 1 wt % headbox consistency were poured into a square mixing jar and diluted to 500 ml with tap water.
2. These contents were mixed using a standard Britt Jar style propeller mixer (1 inch diameter) under the following mixing time (seconds) and speed (rpm) conditions to simulate chemical addition to the secondary fan pump inlet, fan pump outlet, and pressure screen outlet:

| Time | Speed (rpm) | Additive | Feed Point |
|---|---|---|---|
| $t_0$ | 1200 | Starch | Pre-fan |
| $t_{10}$ | 1200 | Flocculant | Pre-screen |
| $t_{20}$ | 600 | Acid colloid | Post-screen |
| $t_{30}$ | Stop | | |

3. The contents in the mixing jar were transferred to a 500 ml graduated drainage tube fitted on the bottom with a 100 mesh screen. The tube was inverted 5 times to ensure that the stock was homogenous. The bottom stopper of the tube was removed and the elution times for 100, 200, and 300 ml elution volumes were measured. The elution time at a volume of 300 ml for an untreated stock blank should preferably be greater than 60 seconds.
4. The improvement in drainage provided by a treatment was calculated as follows based on the drainage time for an untreated, blank sample:

$$\% \text{ Drainage Improvement} = \left(\frac{(\text{Drainage Time With No Treatment(s)} - \text{Drainage Time With Treatment(s)})}{(\text{Drainage Time With No Treatment(s)})}\right) \times 100\%$$

The results for the drainage tube testing are shown in Table 1.

Retention Test Procedure (FPR, FPAR, FPFR)—TAPPI Test Method T269

1. 500 ml of furnish at headbox consistency (1.0%) were poured into a Britt Jar with a 70 mesh screen while stirring the stock at 1200 rpm.
2. The mixing time/speed (seconds/rpm) sequence was similar to that used in the drainage test procedure above in order to simulate chemical addition points with the following change:

at $t_{30}$, the bottom stop cock was opened and the first 100 ml of eluate were collected.
3. This eluate was filtered through a Whatman No. 4 filter paper and dried at 105° C.

4. The pad was burned at 600° C. for 2 hours to determine ash retention.

The results for the retention testing are shown in Tables 2 and 3.

Hand Sheet Preparation and Testing

Handsheets were prepared at 70 grams per square meter basis weight using a Noble & Wood Hand Sheet Mold. This apparatus generates a 20 cm×20 cm square handsheet. The mixing time/speed (seconds/rpm) sequence used in preparing hand sheets was the same as the sequence used for the drainage test procedure. The treated furnish sample was poured into the deckle box of the Noble & Wood handsheet machine and the sheet was prepared employing standard techniques well known by those skilled in the art.

Sheet Properties

Sheet formation was measured on handsheets using an MK Systems Formation Tester, Model M/K950R.

EXAMPLES 1–8

Drainage

The data in Table 1 below show drainage improvement results realized when using 10 and 20 lbs./ton of cationic starch with an anionic HMW flocculant and melamine-formaldehyde (MF) as the acid colloid in the microparticle system of the invention. The cationic starch was fed pre-fan pump, the anionic flocculant was fed pre-screen, and MF was fed post-screen as described herein above for the mixing time and speed sequence in the drainage test procedure.

The data in Table 1 shows an important discovery in the use of MF as a microparticle in the papermaking process. Typically, colloidal silica (a prior art microparticle) requires more than 10 lb/ton of cationic coagulant or starch in order to be an effective drainage aid in the production of paper. The results of Table 1 seem to indicate that the use of an acid colloid, such as melamine formaldehyde, in conjunction with an anionic flocculant can decrease the amount of cationic starch or coagulant needed in a paper mill to attain desirable drainage levels in the paper machine during the paper making process. At higher doses of melamine formaldehyde, it appears that 20 lbs./ton of cationic starch may be beneficial, but the drainage levels may be considered as being "too high" to attain acceptable "on-machine" sheet formation. This data may also indicate that by increasing the MF dosage, the drainage levels can be increased to a desirable level.

TABLE 1

MF Drainage

| Example No. | MF Dosage (lb./ton) Active | 10 lb/ton Starch Drainage Improvement (%) | 20 lb/ton Starch Drainage Improvement (%) |
|---|---|---|---|
| 1 | 0 | 5 | 23 |
| 2 | 0.5 | 26 | 26 |
| 3 | 1.0 | 40 | 37 |
| 4 | 1.5 | 52 | 54 |
| 5 | 2.0 | 60 | 61 |
| 6 | 3.0 | 67 | 74 |
| 7 | 4.0 | 70 | 78 |
| 8 | 5.0 | 72 | 82 |

(Drainage Improvement at 300 ml and 0.5 lb./ton of an active anionic flocculant)

The following Examples 9–14 show comparative data between the colloidal silica presently being as a microparticle particulate material and melamine formaldehyde (MF) as the microparticle particulate material of the invention.

EXAMPLES 9–14

First Pass Retention (FPR)

Table 2, Examples 9–14 demonstrate an enhanced performance from MF compared to silica at the dosages shown with respect to first pass retention when using 10 lb./ton of cationic starch and 0.5 lb./ton of an active anionic flocculant. Retention was measured using the Britt method (TAPPI Test Method T269) according to the mixing sequence discussed herein above in the drainage test procedure.

TABLE 2

First Pass Retention for MF Colloid and Silica Using 10 lb./ton Cationic Starch

| Example No. | Dosage (lb./ton) | Silica FPR (%) | MF (FPR (%) |
|---|---|---|---|
| 9 | 0.0 | 86.25 | 86.25 |
| 10 | 0.5 | 88.18 | 89.37 |
| 11 | 1.0 | 88.82 | 88.38 |
| 12 | 1.5 | 89.71 | 90.37 |
| 13 | 2.0 | 92.13 | 93.18 |
| 14 | 3.0 | 93.53 | 94.35 |

(0.5 lb./ton of an active anionic flocculant)

EXAMPLES 15–20

First Pass Ash Retention (FPAR)

The retention of micron sized fillers is also an important factor in the production of a paper product. The filler materials should be retained in the sheet in order to reduce production costs, to improve the optical properties in the sheet, and to increase the efficiency of the paper machine. The retention of these micron-sized fillers is measured by First Pass Ash Retention (FPAR). Table 3 below illustrates an enhanced performance from MR (present invention) compared to colloidal silica (prior art) at the dosages shown when using 10 lb./ton of cationic starch and 0.5 lb./ton of an active anionic flocculant.

TABLE 3

First Pass Ash Retention for MF Colloid and Silica Using 10 lb./ton Cationic Starch

| Example No. | Dosage (lb./ton) | Silica FPAR (%) | MF (FPAR (%) |
|---|---|---|---|
| 15 | 0.0 | 59.41 | 59.41 |
| 16 | 0.5 | 68.12 | 73.00 |
| 17 | 1.0 | 68.77 | 70.11 |
| 18 | 1.5 | 71.74 | 75.88 |
| 19 | 2.0 | 78.73 | 84.34 |
| 20 | 3.0 | 84.79 | 87.64 |

(0.5 lb./ton of an active anionic flocculant)

It is generally well known to those skilled in the art that drainage levels generally cannot be increased without the possibility of sacrificing the properties in the sheet. Over flocculating a sheet may generally cause poor optical properties and/or sheet formation. Present day microparticle systems may cause severe sheet formation problems if the stock or furnish contains an excess amount of flocculant or if the flocculant is not applied to the stock or furnish properly or is not applied at the proper feed point in the paper machine. A poorly formed sheet will also have difficulty in losing water (dewatering) in the pressing and/or drying sections of the paper machine. As illustrated in Examples 21–23 below, it has been observed that the use of melamine formaldehyde improves sheet formation which may imply that the dewatering process of the sheet in the pressing and/or drying sections of the paper machine is improved when compared to the microparticles of the prior part, such as colloidal silica.

EXAMPLES 21–23

Formation

Table 4 illustrates the advantage of using melamine formaldehyde (MF) as a microparticle particulate material versus using colloidal silica in sheet formation. (The higher the Formation Index, the better the sheet formation.) Generally, high levels of drainage are associated with large decreases in Formation Index. As seen from Examples 22 and 23, at equivalent drainage levels, melamine formaldehyde produced better sheet formation than the colloidal silica of the prior art.

TABLE 4

Formation at Equivalent Drainage for MF Colloid and Silica Using 10 lb./ton Cationic Starch

| Example No. | Silica Dosage (lb./ton) Active | Drainage Improve--ment (%) | MK Forma-tion Index | MF Dosage (lb./ton) Active | Drainage Improve-ment (%) | MK Forma-tion Index |
|---|---|---|---|---|---|---|
| 21 | 0 | 5 | 29.2 | 0 | 5 | 29.2 |
| 22 | 1.0 | 41 | 22.7 | 1.0 | 40 | 28.2 |
| 23 | 2.0 | 51 | 20.5 | 1.5 | 52 | 24.1 |

(0.5 lb./ton of an active anionic flocculant)

Whereas particular embodiments of the present invention have been described for purposes of illustration, it will be evident to those skilled in the art that numerous variations and details of the invention may be made without departing from the invention as defined in the appended claims.

What is claimed is:

1. A microparticle system used as a retention and drainage aid in a paper furnish, comprising:

a) a high molecular weight polymer flocculant being present in an amount of from about 0.0025% to about 1.0% by weight based on the dry weight of the solids in said furnish, and b) an acid colloid comprised of an aqueous solution of a water-soluble polymer or copolymer being present in the amount of from about 0.0005% to about 0.5% by weight based on the dry weight of the solids in said furnish.

2. The system of claim 1 wherein said polymer is selected from the group consisting of a melamine aldehyde, melamine is substituted or unsubstituted; and the aldehyde is

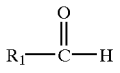

wherein R1 is selected from the group consisting of straight and branched $C_{1-4}$ alkyl.

3. The system of claim 2 wherein the aldehyde is selected from the group consisting of formaldehyde, ethanal, propanal, glyoxal, and glutaraldehyde.

4. The system of claim 3 wherein the aldehyde is formaldehyde.

5. The system of claim 1 wherein said water soluble polymer is melamine-formaldehyde.

6. The system of claim 5 wherein said melamine-formaldehyde is etherified with a linear or branched alcohol.

7. The system of claim 5 wherein said melamine-formaldehyde is at 8% solids in an acidic aqueous environment.

8. The system of claim 1 wherein said acid colloid is a copolymer of melamine-formaldehyde and urea-formaldehyde.

9. The system of claim 1 wherein said acid colloid is a copolymer comprising said melamine aldehyde and condensates selected from the group consisting of ammeline-aldehyde, dicyandiamidealdehyde, biguanidine-aldehyde, ureaformaldehyde polyalkylene polyamine, and polyureido.

10. The system of claim 1 wherein said acid colloid is a copolymer of amine-aldehyde-type and ethylenically unsaturated monomers selected from the group consisting of acrylamide, dimethylaminoethyl acrylate, diallyldimethyl ammonium chloride, and methacrylamidopropyl trimethylammonium chloride.

11. A system of claim 1, further comprising:

a coagulant being present in an amount of from about 0.005% to about 0.5% by weight based on the dry weight of the solids in said furnish.

12. A paper product made with the microparticle system of claim 1, and wherein said acid colloid is melamine-formaldehyde.

13. A paper product made with the microparticle system of claim 2.

14. A method for producing paper products, the steps comprising:

a) after a first high shearing stage and prior to a second high shearing stage, adding to the thin stock flow of a paper furnish a high molecular weight polymer flocculant in an amount ranging from about 0.0025% to about 1.0% by weight based on the dry weight of the solids in the furnish; and b) after said second high shearing stage, adding to said furnish an acid colloid being present in the amount ranging from about 0.0005% to about 0.5% by weight based on the dry weight of the solids in said furnish.

15. A method of claim 14, the steps further comprising:

c) prior to said first high shearing stage, adding a coagulant to the furnish in an amount of about 0.005% to about 0.5% by weight based on the dry weight of the solids in said furnish.

16. A method of claim 14 wherein said acid colloid is a melamine-formaldehyde.

17. A method for producing paper products, the steps comprising:

a) after a first high shearing stage and prior to a second high shearing stage, adding to a thin stock flow of a paper furnish, an acid colloid comprised of melamine formaldehyde being present in an amount ranging from about 0.0005% to about 0.5s by weight based on the dry weight of the solids in said furnish, and b) after said second high shearing stage, adding to said furnish, a high molecular weight polymer flocculant in an amount ranging from about 0.0025% to about 1.0% by weight based on the dry weight of the solids in said furnish.

* * * * *